United States Patent [19]

Belich

[11] Patent Number: 4,564,128

[45] Date of Patent: Jan. 14, 1986

[54] BEVERAGE DISPENSING SYSTEM AND TAP

[76] Inventor: Daniel E. Belich, 6750 W. Monona Pl., Milwaukee, Wis. 53219

[21] Appl. No.: 629,327

[22] Filed: Jul. 10, 1984

Related U.S. Application Data

[63] Continuation of Ser. No. 357,935, Mar. 15, 1982, abandoned.

[51] Int. Cl.[4] ..... B67D 3/04

[52] U.S. Cl. ..... 222/135; 251/115

[58] Field of Search ..... 222/135, 136, 144.5, 222/400.7, 641; 251/93, 112, 121, 115; 138/42, 43, 46

[56] References Cited

U.S. PATENT DOCUMENTS

| | | | |
|---|---|---|---|
| 1,304,157 | 5/1919 | Cogswell | 251/121 |
| 2,372,081 | 3/1945 | Haldane | 251/112 |
| 3,221,936 | 12/1965 | Spinuzza | 222/144.5 X |
| 3,464,591 | 9/1969 | Nicola | 222/144.5 X |

*Primary Examiner*—Stanley H. Tollberg
*Attorney, Agent, or Firm*—Allan B. Wheeler

[57] ABSTRACT

Beverage dispensing system having a single source of pressure for a plurality of containers of a particular beverage and a dispensing line for each container communicating with a separate tap. Pressure regulating structure can be present to accommodate the type of beverage being dispensed from each tap so that beverages having different characteristics can each be dispensed optimally. The taps for a particular beverage are mounted together, and each is provided with a lock, allowing the operator to select which tap will operate at a given time and disable the other taps.

3 Claims, 7 Drawing Figures

BEVERAGE DISPENSING SYSTEM AND TAP

This is a continuation, of application Ser. No. 357,935, filed Mar. 15, 1982 now abandoned.

BACKGROUND ART

Pressurized beverage dispensing systems, particularly for beer, have conventionally been arranged as shown in FIG. 1. Two or more barrels or other containers 10 have been connected to a common source 20 of a gas such as carbon dioxide to pressurize them, and the lines 12 conducting the beverage from the respective containers have been connected via a selection valve 14 to a single line 16 running from a remote storage area for the beverage containers to a single faucet or tap 18 for dispensing the beverage. In an alternate system known to the art each container has had an independent tap line running to an independent tap, with line valves for each tap line located in the container storage area.

It is desirable to dispense beverages sequentially from more than one container because more of the beverage can be dispensed from the tap without leaving the dispensing area, and because one container can be drawn at a time, avoiding the problem of waste due to spoilage of partially full containers. But the system previously described does not meet the first stated objective because each time a container is emptied one must go to the container storage area to operate valve 14, or a line valve, even though such a trip would not be necessary to tap new containers. This procedure is especially troublesome if the beverage storage area is remote from the bar. If only one bartender is attending the tap, he or she must leave the bar to shift valve 14. This system also does not provide a backup line in case line 16 becomes filled with air or gas, rendering it temporarily unusuable for dispensing a beverage such as beer.

Another problem with existing systems is that when more than one beverage is to be dispensed, separate lines 12, valves 14, lines 16 and taps 18 are provided for each beverage, but a single source of pressure such as a cylinder or pressurized gas commonly furnishes pressure to drive different beverages through their respective dispensing systems. The various beverages dispensed differ in their physical characteristics, particularly their density, their tendency to foam, and the amount of dissolved and entrained gas present in each. When each beverage is driven at a common pressure they dispense very differently at the taps so that a light beer may be dispensed as foamy "wild beer", while a stout may be dispensed quite slowly.

SUMMARY OF THE INVENTION

In the improved beer dispensing apparatus of my invention a single pressure source of the known type is used to drive various beverages from their plural containers through dispensing lines to the dispensing apparatus. However, a separate dispensing line and tap is provided for each barrel or other container connected to the dispensing apparatus. At least one beverage is dispensed from two or more containers connected to separate dispensing lines which extend to a single block where a tap is provided for each line.

Each tap can be equipped with an adjustable flow control which can be set to suit the characteristics of the beverage being dispensed through it.

For beverages dispensed from more than one tap, each tap can have a dispensing lock which temporarily secures the tap in its closed position. The lock preferably comprises a screw received by a bore in the exposed end of the valve slide of the tap. The screw may be finger tightened to bring its head into engagement with the valve body so the valve slide is locked against movement. Incorporation of these locks in the system allows the person dispensing beverages to select which of the taps for a particular beverage shall be in use at a given time so that one beverage container can be emptied before other containers are drawn. A new container can be drawn by engaging the lock of the container previously being drawn and disengaging the lock of the tap for the new container. There is no need to switch a remote valve to draw from a new container. Because the dispensing lines are separate the new container can be drawn without purging its line (assuming it has been properly tapped and connected to the dispensing line).

As a sub-combination of my invention a top having a flow control has separate utility even in the old dispensing system, whether or not my novel dispensing system is used to provide an independent beverage dispensing line from each beverage container.

DETAILED DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 2:
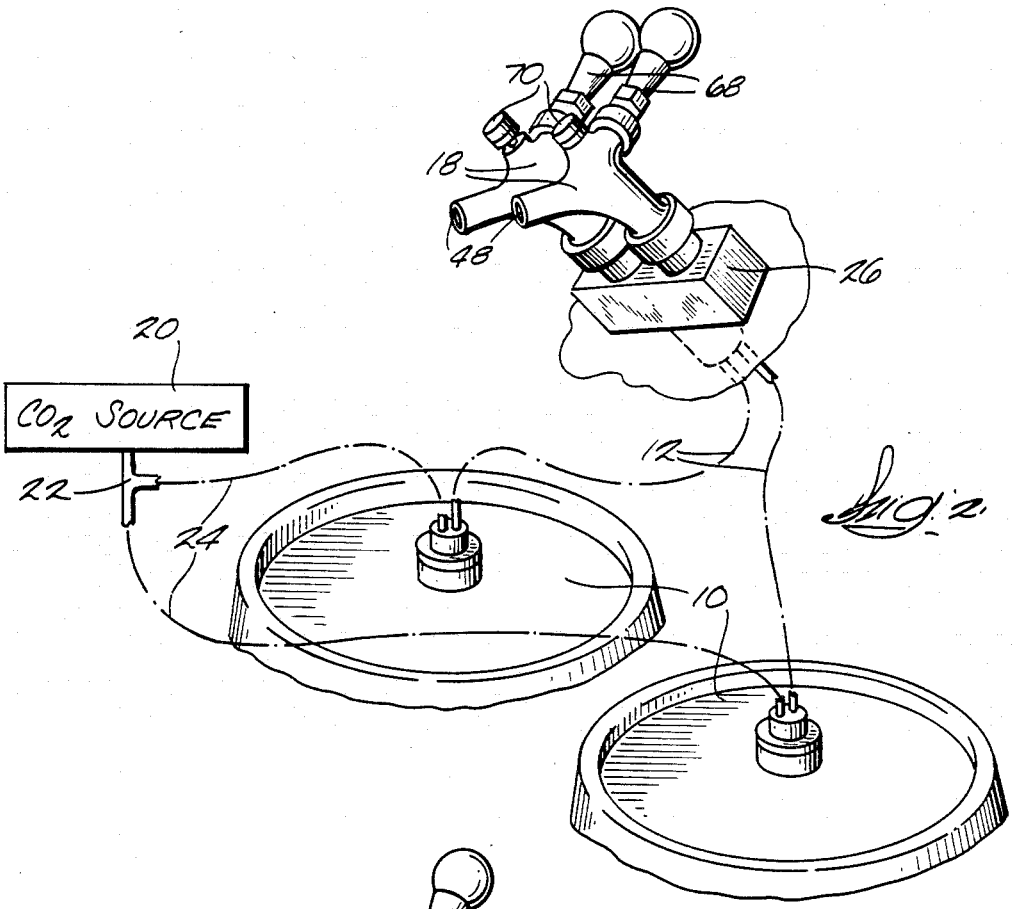
FIG. 2 is a schematic view of the dispensing system of my invention.
Figure 1:
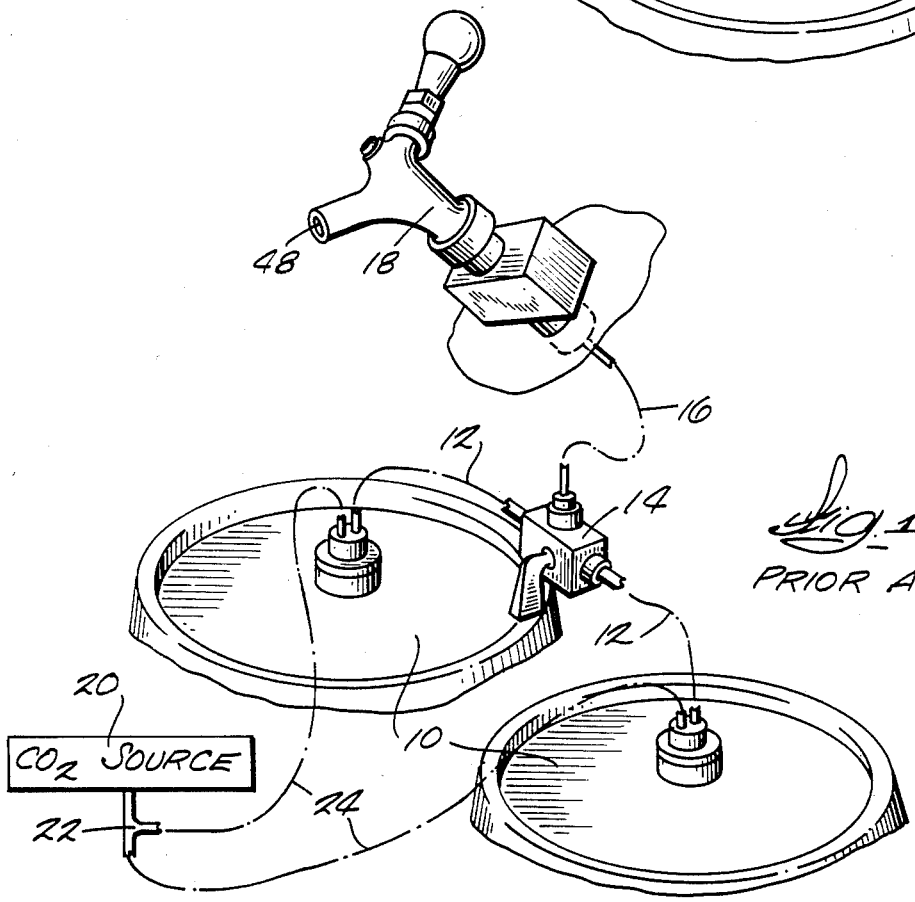
Fig. 1 PRIOR ART
FIG. 1 is a schematic view of a prior art multicontainer beverage dispensing system.

FIG. 2 shows the conventional and new elements of the present dispensing system. As in the prior art system shown in FIG. 1, plural barrels or other containers 10 are provided for each beverage to be dispensed, a tap line 12 extends from each barrel, and carbon dioxide under pressure is supplied from source 20 via manifold 22 and conduits 24 to each container 10 for driving the contents of the barrels through the tap lines.

In the system according to the present invention tap lines 12 extend from containers 10 to tap block 26. Separate passages in tap block 26 communicate between each tap line 12 and the corresponding tap 18. One tap is provided for each container of a particular type of beverage. Thus, the contents of each barrel is conveyed through a separate line to the point of dispensing, with the advantages previously noted.

Turning now to FIGS. 3 through 6 the novel flow control valve and tap block of the present invention is shown in greater detail.

Figure 3:
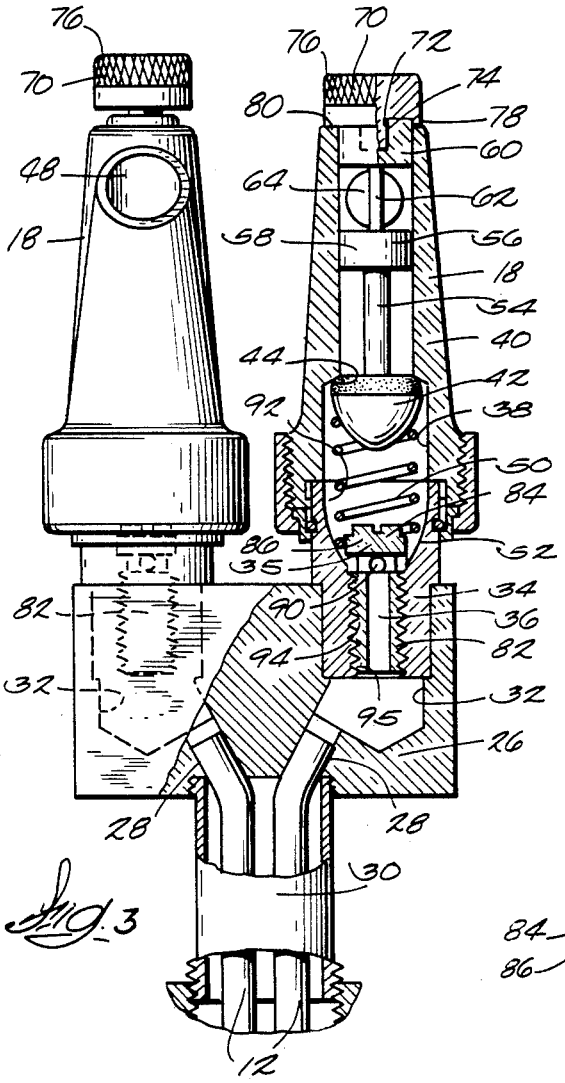
FIG. 3 is a bottom plan view of my improved dispensing tap set, with portions broken away to show internal structure.
Figure 4:
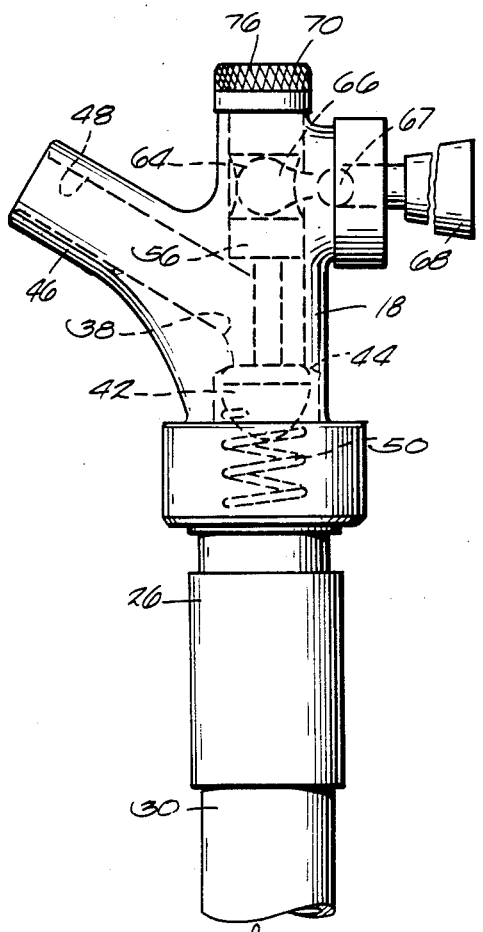
FIG. 4 is a side elevational view of the structure shown in FIG. 3, with portions broken away to show internal structure.

The flow of the beverage through the taps, tap block and tap lines shown in FIGS. 3 and 4 is as follows. A beverage is conducted via each tap line 12 to one of the passages 28 formed in tap block 26. A stem 30 is threaded to tap block 26 and can be received by suitable means for mounting tap block 26 securely in place. Each passage 28 communicates with a bore 32 in block 26 in which valve body 34 of a flow control valve is secured. The beverage then flows from the interior of bore 32 through flow control valve 35 via an axial passage 36 to an axial bore 38 in the valve body 40 of the shutoff valve for tap 18. The beer conducted through axial passage 38 passes plug 42 when the valve is open and is stopped by plug 42 urged against seat 44 when tap 18 is closed. When the tap is open, the beverage emerges from a spout 46 having an internal bore 48 which communicates with axial passage 38.

The shut-off valve is conventional, and works as follows. Plug 42 is normally urged against seat 44 by line pressure, assisted by a compression spring 50 received between plug 42 and a shoulder 52, here formed within flow control valve body 34. Plug 42 is connected by a stem 54 to a slide generally indicated at 56. Slide 56 has a piston 58 formed at one end to prevent axial diversion of the dispensed beverage. The other axial end 60 of slide 56 is flush with or protrudes slightly from the open end of bore 38 when the tap is closed and is withdrawn into valve body 40 when the tap is opened. Between piston 58 and end 60 slide 56 has a reduced central portion 62 which is received by the forked end 64 of a valve operator 66 which pivots at ball joint 67; slide 56 is thrust substantially axially by operation of tap lever 68. Thus, when the tap lever 68 as shown in FIG. 4 is tilted downward, responsive to line pressure and the bias of spring 50, plug 42 moves axially downstream to the position shown in the figures. When tap lever 68 is moved upward as shown in FIG. 4, or toward the bartender, slide 56 is thrust upstream, unseating plug 42 and thereby allowing a beverage to be dispensed through spout 46.

The novel lock shown in FIGS. 3 and 4 for temporarily preventing a particular tap 18 from being operated comprises a screw 70 having a threaded shank 72 received in the threaded bore 74 of end 60 of slide 56, a knurled head 76 for easily advancing or retracting the screw, and a peripheral skirt 78 depending from head 76 for bearing against the lip 80 of valve body 40. (Skirt 78 can be eliminated if end 60 does not protrude from lip 80 of the tap when it is closed.) When skirt 78 bears against lip 80, as shown in the figures, slide 56 cannot be withdrawn axially into bore 38 to open the tap. Since a lock is provided for each tap 18, one tap is locked by advancing its screw 70 into its bore 74 while the next tap is unlocked by the opposite procedure. This lock is provided not so much for security as to avoid inadvertently drawing a particular beverage from more than one tap at a time.

Figure 5:
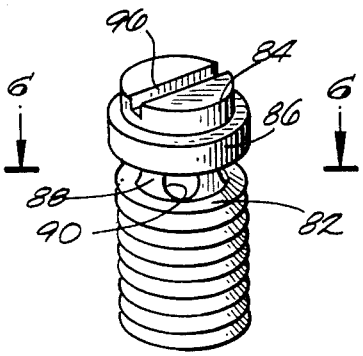
FIG. 5 is a perspective view of one of the flow control valve members incorporated in the tap set shown in FIGS. 3 and 4.
Figure 6:
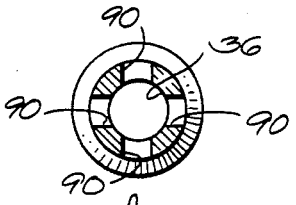
FIG. 6 is a cross sectional view taken along line 6—6 of FIG. 5.

FIGS. 3 and 4 show the environment and FIGS. 5 and 6 show details of a flow control valve generally denoted at 35 for regulating the flow rate of a beverage being dispensed, allowing adjustment of the flow rate to compensate for the dispensing properties of a particular beverage. Flow control valve 35 comprises a valve element 82 threadably received within valve body 34. Element 82 has a head 84 having an enlarged base 86 for regulating flow and assisting in seating spring 50, a coaxial bore 36 which terminates within a shank portion 88 of reduced diameter, and plural passages 90 communicating between bore 36 and the mouth 92 of bore 94, which (as shown in FIG. 3) merges with axial bore 38. Bore 94 increases in diameter between its threaded inlet 95 and mouth 92. When element 82 is threaded into bore 94, flow from passages 90 through the annular passage between base 86 and bore 94 is restricted. When flow control valve element 82 is threadably withdrawn from bore 94 the annular passage adjacent each bore 90 becomes less constricted and flow is increased. Valve element 82 has a slot 96, so it is easily rotated with a screwdriver for setting flow control valve element 82 in the appropriate position. The flow control valves can be located within the beverage filled passages of the tap because in an established system the beverage to be dispensed through a given tap is only infrequently changed. Location of the flow control within the tap also prevents casual adjustments of flow.

Figure 7:
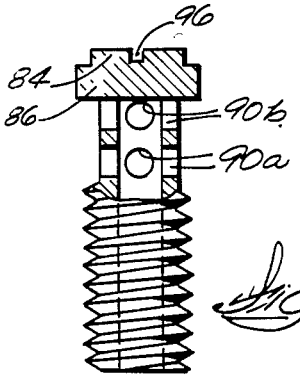
FIG. 7 is a side elevational view of an alternate embodiment of the flow control valve member of FIGS. 3–6.

FIG. 7 illustrates that some bores 90*a* can be axially displaced from other bores 90*b* to provide a greater range of flow rate adjustment.

I claim:

1. A beverage dispensing system for conveying beverages from plural remote containers to dispensing means in a tapping area, comprising:

A. an independent tap line communicating between each beverage container and an independent tap in the tapping area; and B. means in the tapping area for enabling and disabling the operation of each said tap; and a valve body and a slide movable within said body for operating said tap, an end portion of said slide being withdrawn within said tap body when said tap is opened; a novel locking device comprising a screw having a shank for being threaded into a corresponding bore in the end portion of said slide and a head for bearing against an external portion of said valve body to prevent said slide from being withdrawn into said body when said screw is advanced into said threaded bore, and to allow said slide to be withdrawn into said valve body when said shank is threadedly retracted at least part way out of the bore in said slide, whereby to provide a system in which the plural containers can be successively drawn without leaving the tapping area by enabling one tap at a time and disabling the taps not in immediate use.

2. The tap of claim 1, wherein said head has a depending skirt for bearing against an axial end of the valve body for locking said slide in its closed position.

3. The dispensing system of claim 1, wherein each said tap is provided with flow regulating means for adapting it to the dispensing characteristics of a particular beverage.

* * * * *